US011473230B2

(12) United States Patent
Bergamo et al.

(10) Patent No.: US 11,473,230 B2
(45) Date of Patent: Oct. 18, 2022

(54) SELECTABLE METHOD OF CONTROL FOR DOUBLE BASKET LAUNDRY TREATING APPLIANCE

(71) Applicant: WHIRLPOOL CORPORATION, Benton Harbor, MI (US)

(72) Inventors: Danilo Antonio Bergamo, Batatais (BR); Rogerio C. Junior, Joinville (BR); Mauro R. Ushizima, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 308 days.

(21) Appl. No.: 15/651,570

(22) Filed: Jul. 17, 2017

(65) Prior Publication Data

US 2019/0017212 A1 Jan. 17, 2019

(51) Int. Cl.

| | |
|---|---|
| ***D06F 37/12*** | (2006.01) |
| ***D06F 33/00*** | (2020.01) |
| ***D06F 34/28*** | (2020.01) |
| ***D06F 13/00*** | (2006.01) |
| *D06F 23/04* | (2006.01) |
| *D06F 29/00* | (2006.01) |
| *D06F 103/00* | (2020.01) |
| *D06F 105/58* | (2020.01) |

(Continued)

(52) U.S. Cl.

CPC ..... *D06F 34/28* (2020.02); *D06F 13/00* (2013.01); *D06F 23/04* (2013.01); *D06F 29/00* (2013.01); *D06F 34/32* (2020.02); *D06F 37/12* (2013.01); *D06F 2101/00* (2020.02); *D06F 2101/20* (2020.02); *D06F 2103/00* (2020.02); *D06F 2105/58* (2020.02); *D06F 2105/60* (2020.02)

(58) Field of Classification Search

CPC ..... D06F 37/12; D06F 39/005; D06F 33/02; D06F 34/28

See application file for complete search history.

(56) References Cited

U.S. PATENT DOCUMENTS

| | | | |
|---|---|---|---|
| 1,795,395 | A | 3/1931 | Hoke |
| 2,019,089 | A | 10/1935 | Papworth |

(Continued)

FOREIGN PATENT DOCUMENTS

| | | |
|---|---|---|
| BR | DI7003246-7 | 10/2011 |
| BR | 102013015674 A2 | 7/2015 |

(Continued)

OTHER PUBLICATIONS

KR20150030806—Machine Translation (Year: 2015).*

*Primary Examiner* — Marc Lorenzi
(74) *Attorney, Agent, or Firm* — McGarry Bair PC

(57) ABSTRACT

An apparatus and method of operating a laundry treating appliance can include a first basket defining a first treating chamber and a second basket defining a second treating chamber. A liquid supply system can selectively supply water to the first basket, second basket, or both of the first and second baskets. A user interface can be configured to receive input from a user. A controller can operably couple with the liquid supply system and the user interface. The controller can receive an input at the user interface to a configuration type for the laundry treating appliance and can indicate treatment variable available to the user reflective of the configuration type.

10 Claims, 11 Drawing Sheets

(51) Int. Cl.

| | |
|---|---|
| *D06F 105/60* | (2020.01) |
| *D06F 34/32* | (2020.01) |
| *D06F 101/00* | (2020.01) |
| *D06F 101/20* | (2020.01) |

(56) References Cited

U.S. PATENT DOCUMENTS

| | | | | |
|---|---|---|---|---|
| 2,218,275 | A | 10/1940 | Woodin | |
| 2,748,788 | A | 6/1956 | Duckstein | |
| 3,014,358 | A | 12/1961 | Bochan | |
| 3,026,699 | A | 3/1962 | Rhodes | |
| 3,029,623 | A | 4/1962 | Morey | |
| 3,145,551 | A | 8/1964 | Ziegler | |
| 3,209,560 | A | 10/1965 | Shelton | |
| 3,324,688 | A * | 6/1967 | Hubbard | D06F 29/02 68/4 |
| 3,481,162 | A | 12/1969 | Ziegler | |
| 3,509,741 | A | 5/1970 | Morey | |
| 3,575,020 | A | 4/1971 | Hubbard | |
| 3,648,486 | A | 3/1972 | Rosinski, Jr. et al. | |
| 3,736,773 | A | 6/1973 | Waugh | |
| 3,987,652 | A | 10/1976 | Ruble | |
| 4,118,957 | A | 10/1978 | Marcussen | |
| 4,162,621 | A | 7/1979 | Stone | |
| 4,175,409 | A | 11/1979 | Morey | |
| 4,186,573 | A | 2/1980 | Brenner et al. | |
| 4,207,760 | A | 6/1980 | Bochan | |
| 4,225,992 | A | 10/1980 | Morey | |
| 4,338,802 | A | 7/1982 | Ohmann et al. | |
| 4,417,457 | A | 11/1983 | Brenner | |
| 4,502,303 | A | 3/1985 | Wasemann | |
| 4,637,230 | A | 1/1987 | Roberts | |
| 4,637,231 | A | 1/1987 | McMillan et al. | |
| 4,862,711 | A * | 9/1989 | Ikeda | D06F 39/005 68/12.18 |
| 4,920,770 | A | 5/1990 | Dooley et al. | |
| 5,113,542 | A | 5/1992 | Pastryk et al. | |
| 5,440,903 | A | 8/1995 | Kropf et al. | |
| 5,497,638 | A | 3/1996 | Berkcan et al. | |
| 5,500,967 | A | 3/1996 | Wilson et al. | |
| 5,611,221 | A | 3/1997 | Tremel | |
| 5,651,277 | A | 7/1997 | Richardson | |
| 5,689,847 | A | 11/1997 | Tremel et al. | |
| 5,784,902 | A | 7/1998 | Pinkowski et al. | |
| 5,855,127 | A | 1/1999 | Kohara et al. | |
| 6,160,245 | A * | 12/2000 | Broker | D06F 39/005 219/412 |
| 6,460,382 | B1 | 10/2002 | Kim et al. | |
| 7,401,479 | B2 | 7/2008 | Fields | |
| 7,866,191 | B2 | 1/2011 | Turner et al. | |
| 9,091,013 | B2 | 7/2015 | Kim et al. | |
| 9,404,213 | B2 | 8/2016 | Kappler | |
| 2004/0116267 | A1 | 6/2004 | Mathieu et al. | |
| 2005/0284197 | A1 | 12/2005 | Pinkowski et al. | |
| 2007/0084254 | A1 | 4/2007 | Messina | |
| 2007/0199664 | A1 | 8/2007 | Zacher et al. | |
| 2007/0241938 | A1 * | 10/2007 | Ulius-Sabel | D06F 34/32 341/22 |
| 2008/0312773 | A1 * | 12/2008 | Nag | A47L 15/4293 700/275 |
| 2009/0211108 | A1 | 8/2009 | Moschutz et al. | |
| 2009/0293203 | A1 | 12/2009 | Hettinger et al. | |
| 2010/0326141 | A1 | 12/2010 | Chung | |
| 2011/0094902 | A1 | 4/2011 | Delehey et al. | |
| 2013/0276483 | A1 | 10/2013 | Ryu et al. | |
| 2013/0312462 | A1 | 11/2013 | Kim et al. | |
| 2015/0059417 | A1 | 3/2015 | Ramasco | |
| 2015/0184326 | A1 | 7/2015 | Seo et al. | |
| 2015/0211163 | A1 | 7/2015 | Kim et al. | |
| 2016/0201243 | A1 | 7/2016 | Bergamo | |
| 2016/0222567 | A1 | 8/2016 | Ramasco et al. | |
| 2016/0289884 | A1 * | 10/2016 | Kim | D06F 39/088 |
| 2016/0296865 | A1 | 10/2016 | Blanks et al. | |
| 2018/0237972 | A1 | 8/2018 | Lv et al. | |
| 2018/0371668 | A1 | 12/2018 | Yonezawa et al. | |
| 2019/0186064 | A1 * | 6/2019 | Kim | D06F 39/12 |

FOREIGN PATENT DOCUMENTS

| | | | | |
|---|---|---|---|---|
| BR | 102013018364 | A2 | 8/2015 | |
| BR | 102013021866 | A2 | 8/2015 | |
| BR | 102013015672 | A2 | 9/2015 | |
| BR | 102013027400 | A2 | 9/2015 | |
| BR | 102013025343 | A2 | 11/2015 | |
| BR | 102014008903 | A2 | 12/2015 | |
| BR | 102014010905 | A2 | 12/2015 | |
| BR | 102014010908 | A2 | 12/2015 | |
| BR | 102014018397 | A2 | 2/2016 | |
| CN | 203530690 | U | 4/2014 | |
| CN | 203729101 | U | 7/2014 | |
| CN | 105220395 | A | 1/2016 | |
| KR | 20030045447 | A | 6/2003 | |
| KR | 20150030806 | A * | 3/2015 | |
| KR | 20150077264 | A | 7/2015 | |
| WO | WO-2006087735 | A1 * | 8/2006 | D06F 33/00 |
| WO | 2013088426 | A2 | 6/2013 | |
| WO | 2014201534 | A1 | 12/2014 | |
| WO | 2015048870 | A1 | 4/2015 | |
| WO | 2015058269 | A1 | 4/2015 | |

* cited by examiner

SELECTABLE METHOD OF CONTROL FOR DOUBLE BASKET LAUNDRY TREATING APPLIANCE

BACKGROUND

Laundry treating appliances, such as clothes washers, refreshers, and non-aqueous systems, can have a configuration based on a rotating basket that defines a treating chamber in which laundry items are placed for treating. The laundry treating appliance can have a controller that implements a number of pre-programmed cycles of operation having one or more operating parameters. The controller can control a motor to rotate the drum according to one of the pre-programmed cycles of operation. The controller can control the motor to rotate the drum at the same speeds for a give pre-programmed cycle of operation regardless of the characteristics of the laundry items or changes in the system.

BRIEF SUMMARY

In one aspect, the disclosure relates to a laundry treating appliance including a first basket defining a first treating chamber for receiving laundry for treatment according to a selected cycle of operation. A second basket is selectively receivable within at least a portion of the first treating chamber. The second basket defines a second treating chamber for receiving laundry for treatment according to the selected cycle of operation. A liquid supply system selectively supplies water to the first basket, the second basket, or both of the first and second baskets. A user interface is configured to receive input from a user and provide output to the user. A controller operably couples with the liquid supply system and the user interface. The controller is configured to receive an input, via the user interface, indicative of a selectable configuration for the first and second baskets and implement the selected cycle of operation based upon the input.

In another aspect, the disclosure relates to a method of displaying selection information on a user interface of a laundry treating appliance. The laundry treating appliance includes a first basket defining a first treating chamber for receiving laundry for treatment and a second basket selectively receivable within at least a portion of the first treating chamber. The second basket defines a second treating chamber for receiving laundry for treatment. The laundry treating appliance is customizable by a user to operation in one of multiple configurations. The method includes: displaying, on the user interface, user-selectable options for configuration type and at least one treatment variable; in response to receiving user selections for the configuration type, displaying on the user interface user-selectable options for the at least one treatment variable; and in response to receiving a user selection from the user-selectable options, executing a cycle of operation according to the user-selected configuration type and at least one treatment variable.

In yet another aspect, a method for displaying information on a user interface of a laundry treating appliance that is customizable by a user to operate in one of multiple configurations, including: determining, via input on a user interface, a selected one of the multiple configurations to include a first configuration where laundry is treated in a first basket, a second configuration where laundry is treated in a second basket at least partially located in the first basket, and a third configuration where laundry is treated in the first basket and the second basket; and indicating user selectable options for water level based on the selected one of the multiple configurations.

DETAILED DESCRIPTION

Aspects of the disclosure relate to a laundry treating appliance including a dual-basket system having a lower, first basket and a removable second basket that can be optionally received in the first basket. A first treating chamber is formed by the first basket and a second treating chamber is formed by the second basket, when it is included. A cycle of operation can be used to treat laundry articles within one or both of the first and second treating chambers. A cycle of operation can be controlled at a user interface and can be tailored to each treating chamber. An intuitive user interface can assist the user in properly determining washing parameters, such as water level and supply, to prevent improper washing or minimize wasted water. Restricting the water volume to the first treating chamber can prevent water spilling during use of both the first and second baskets.

When a dual-basket system is utilized including the first and second baskets, a user can select a cycle of operation that is tailored to the first treating chamber and the second treating chamber, individually. In the dual-basket system, the second basket occupies a portion of the first treating chamber. As such, the volume of the first treating chamber is necessarily decreased. Therefore, in the event that first treating chamber were to be fully filled with water, such as during a large load of laundry articles, some water can be spilled resultant of the decreased capacity due to the inclusion of the second basket. Such spilling can result in leakage or damage to the laundry treating appliance, as well as a negative user experience.

Therefore, a user interface can be tailored to determine the existence of the second basket and tailor the user interface in order to prevent spilling of any excess water. For example, operability of the water level selection at the user interface can be limited to prevent any spilling or unnecessary use of water based upon the particular use of the dual basket system. Specifically, functionality of the water level selection can be limited to less than full operability to prevent spilling or over-filling of water. Furthermore, in the situation where the user would only like the use the second basket, water can be prevented from filling in the lower, first basket to minimize or prevent wasting of water when a portion of the laundry treating appliance is not being used.

Figure 1:
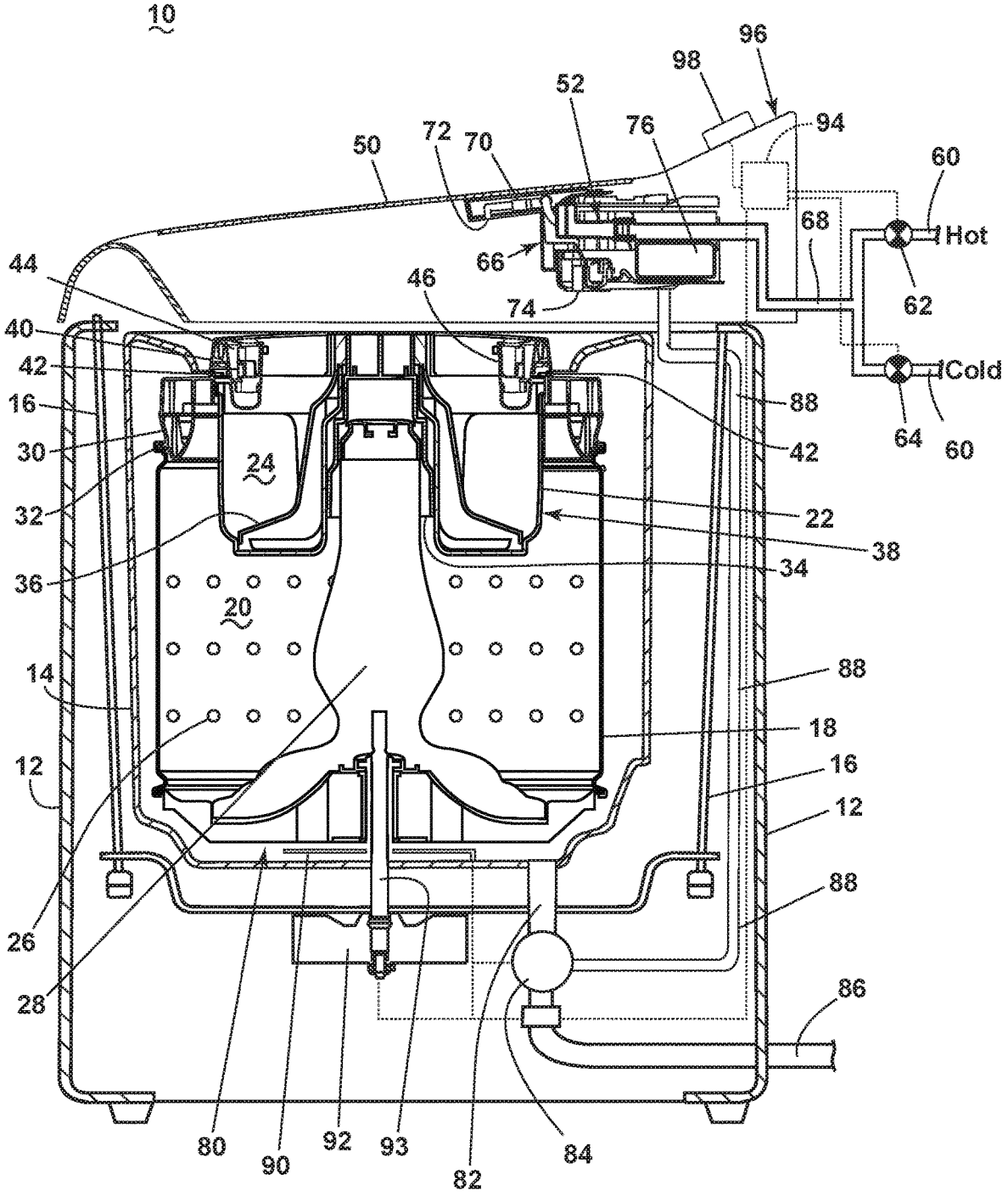
FIG. 1 is a schematic view of a laundry treating appliance in the form of a washing machine according having a first basket and a removable basket assembly.

Referring now to FIG. 1 a laundry treating appliance 10 can be any appliance that performs a cycle of operation to clean or otherwise treat items or articles placed therein, such as clothing laundry in one non-limiting example. The laundry treating appliance 10 is illustrated as a washing machine, which can include a structural support system comprising a cabinet 12, which defines a housing within which a laundry holding system resides. The cabinet 12 can be a housing having a chassis and/or a frame, defining an interior, enclosing components typically found in a conventional washing machine, such as motors, pumps, fluid lines, controls, sensors, transducers, and the like. Such components will not be described further herein except as necessary for a complete understanding of the invention.

The laundry treating appliance 10 includes a tub 14 supported within the cabinet 12 by a suitable suspension system 16 for dynamically suspending portions of the laundry treating appliance 10 within the cabinet 12. A first basket 18 is provided within the tub 14 and defines a first treating chamber 20. The first basket 18 can include a plurality of perforations 26 such that liquid can flow between the tub 14 and the first basket 18 through the perforations 26. A first clothes mover 28 is provided the first treating chamber 20 to move or agitate laundry articles received in the first treating chamber 20 according to a cycle of operation. Clothes mover as used herein can mean any suitable clothes mover to impart mechanical energy to a load of laundry, such as an agitator, mover, blade, impeller, or auger in non-limiting examples. A balance ring 30 can be provided along an upper edge 32 of the first basket 18.

A removable basket assembly 38 can include a second basket 22 that is at least partially provided within the first basket 18 and defines a second treating chamber 24. A transmitter 34 can be included in the removable basket assembly 38 and can removably attach to the first clothes mover 28. The transmitter 34 facilitates attachment and removal of the removable basket assembly 38 to and from the first clothes mover 28 to position the second basket 22 at least partially within the first treating chamber 20. A second clothes mover 36 is provided within the second basket 22 and is coupled with the first clothes mover 28 via the transmitter 34.

An upper ring 40 can be included in the removable basket assembly 38 and can operably couple to the second basket 22. The upper ring 40 can include an outer diameter that is greater than a diameter of the second basket 22. The upper ring 40 can extend at least partially over and seat upon the balance ring 30, such that the balance ring 30 can at least partially support the removable basket assembly 38 at the upper ring 40. A set of outlets 42 can be provided in the upper ring 40 to provide egress for liquid from the second basket 22. A set as used herein can include any number of elements, including only one. A detergent dispenser 44 and a fabric softener dispenser 46 can mount along the interior of the upper ring 40 and extend into the second treating chamber 24. Furthermore, the upper ring 40 can partially form the dispensers 44, 46. While the dispensers 44, 46 are described as specific to detergent and fabric softener, the dispensers 44, 46 can be used for dispensing any suitable treating chemistry into the second basket 22, which can be particular to a cycle of operation, including but not limited to water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. In one non-limiting example, the detergent dispenser 44 can be a dispenser as disclosed in U.S. Pub. No. 2015/0059417 to Ramasco, filed Aug. 27, 2014, now abandoned entitled "Valved Dispensing System for Products in Liquid Form by Inertial Centrifugal Action for Household Appliances," which is herein incorporated by reference in full.

The removable basket assembly 38 can further include coupling elements disposed on the periphery of the second basket 22. Such coupling elements can couple the removable basket assembly 38 to the first basket 18 and permit common rotation among the two. In one non-limiting example, the coupling elements can be similar to those as disclosed in U.S. Pub. No. 2016/0222567 to Ramasco et al., filed Oct. 23, 2015, now U.S. Pat. No. 9,863,078, issued Jan. 9, 2018, entitled "Coupling System of Removable Compartment for Appliances," which is herein incorporated by reference in full, and the removable basket assembly 38 can couple in the same manner as described therein.

It should be appreciated that the removable basket assembly 38 is removable, such that the laundry treating appliance 10 can be used with or without the removable basket assembly 38. The balance ring 30 on the first basket 18 and the transmitter 34 coupled to the first clothes mover 28 are used to support the removable basket assembly 38.

The laundry treating appliance 10 can further include a door 50, which can be movably mounted to the cabinet 12 to selectively close the tub 14, the first basket 18, or the second basket 22. The laundry treating appliance 10 can further include a liquid supply system 52 for supplying water to the laundry treating appliance 10 for use in treating laundry during a cycle of operation. The liquid supply system 52 can include a source of water, such as a household water supply 60, which can include separate valves 62 and 64 for controlling the flow of hot and cold water, respectively. Water can be supplied to a liquid manifold 66 via a supply conduit 68. Optionally, one or more additional valves can be included on the supply conduit 68 to selectively provide water to the liquid manifold 66, or to tailor water temperature from the household water supply 60. A water dispenser 70, fluidly coupled to the liquid manifold 66, can mount to the door 50, for providing water to one or more of the first and second baskets 18, 22 via a first outlet 72. The water dispenser 70 can overhang above the first and second baskets 18, 22 such that water dispensed from the first outlet 72 can pass into the second basket 22 when using the removable basket assembly 38, or into the first basket 22 when the removable basket assembly 38 is not being used. A second outlet 74 can be provided on the liquid manifold 66 dedicated to the first basket 18. The second outlet 74 can be positioned outside of the second basket 22, such that any dispensed water will pass into the space between the tub 14 and the upper ring 40, passing into the first treating chamber 20, but not into the second treating chamber 24. The water dispenser 70 can be dedicated to the removable basket assembly and the second outlet 74 can be dedicated to the first basket 18; however, the laundry treating appliance 10 should not be so limited.

A dispenser 76 can be provided within or adjacent to the liquid manifold 66 and in fluid communication with the liquid manifold 66. The dispenser 76 can be used to dispense treating chemistry to the first basket 18 through the second outlet 74. Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also include a recirculation and drain system for recirculating or draining liquid within the laundry treating appliance 10. Liquid supplied to the tub 14 typically enters a space between the tub 14 and the first basket 18 and can flow by gravity to a sump 80 formed in part by a lower portion of the tub 14. The sump 80 can also be formed by a sump conduit 82 that can fluidly couple the lower portion of the tub 14 to a pump 84. The pump 84 can direct liquid to a drain conduit 86, which can drain the liquid from the laundry treating appliance 10, or to a recirculation conduit 88, which can direct the liquid from the sump conduit 82 into the liquid manifold 66, which can be returned to one or more of the first or second treating chambers 20, 24. In this manner, liquid provided to the tub 14, with or without treating chemistry can be recirculated into either the first or second treating chambers 20, 24 for treating the laundry per one or more cycles of operation.

The liquid supply and/or recirculation and drain system can be provided with a heating system which can include one or more devices for heating laundry and/or liquid supplied to the tub 14, such as a sump heater 90, which can be used to heat the laundry and/or liquid within the tub 14 as part of a cycle of operation.

Additionally, the liquid supply, recirculation and drain system can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry.

The laundry treating appliance 10 also includes a drive system for rotating the first and second baskets 18, 22 within the tub 14. The drive system can include a motor 92, which can be directly coupled with the first basket 18 and the first clothes mover 28 through a drive shaft 93 to rotate or reciprocate the first basket 18 or the first clothes mover 28 about a rotational axis during a cycle of operation. Additionally, the rotational movement of the first clothes mover 28 can be imparted to the second clothes mover 36 and rotational movement of the first basket 18 can be imparted to the second basket 22. The motor 92, in one non-limiting example, can be a brushless permanent magnet (BPM) motor. Other motors, such as an induction motor or a permanent split capacitor (PSC) motor, can also be used. The motor 92 can rotate the first basket 18 and the second basket 22 at various speeds in either rotational direction, and can reciprocate the first and second clothes movers 28, 36 within its respective basket.

The laundry treating appliance 10 also includes a control system for controlling the operation of the laundry treating appliance 10 to implement one or more cycles of operation. The control system can include a controller 94 located within the cabinet 12 and a user interface 96 that is operably coupled with the controller 94. The controller 94 operably couples to the liquid supply system 52 and the user interface 96. The user interface 96 is configured to receive input from a user and provide output to the user. Such input can be used to select a cycle of operation, for example, and output can include information related to the cycle of operation, such as status. The input can be communicated to the controller 94, indicative of and including instructions to execute the cycle of operation. The user interface 96 can include one or more knobs 98, dials, switches, displays, touch screens and the like for communicating with the user, such as to receive input and provide output. The user can enter different types of information including, without limitation, cycle selection and cycle parameters, such as cycle options.

The controller 94 can include the machine controller and any additional controllers provided for controlling any of the components of the laundry treating appliance 10. For example, the controller 94 can include the machine controller and a motor controller. It is contemplated that the controller 94 is a microprocessor-based controller that implements control software and sends/receives one or more electrical signals to/from each of the various working components to effect the control software.

Figure 2:
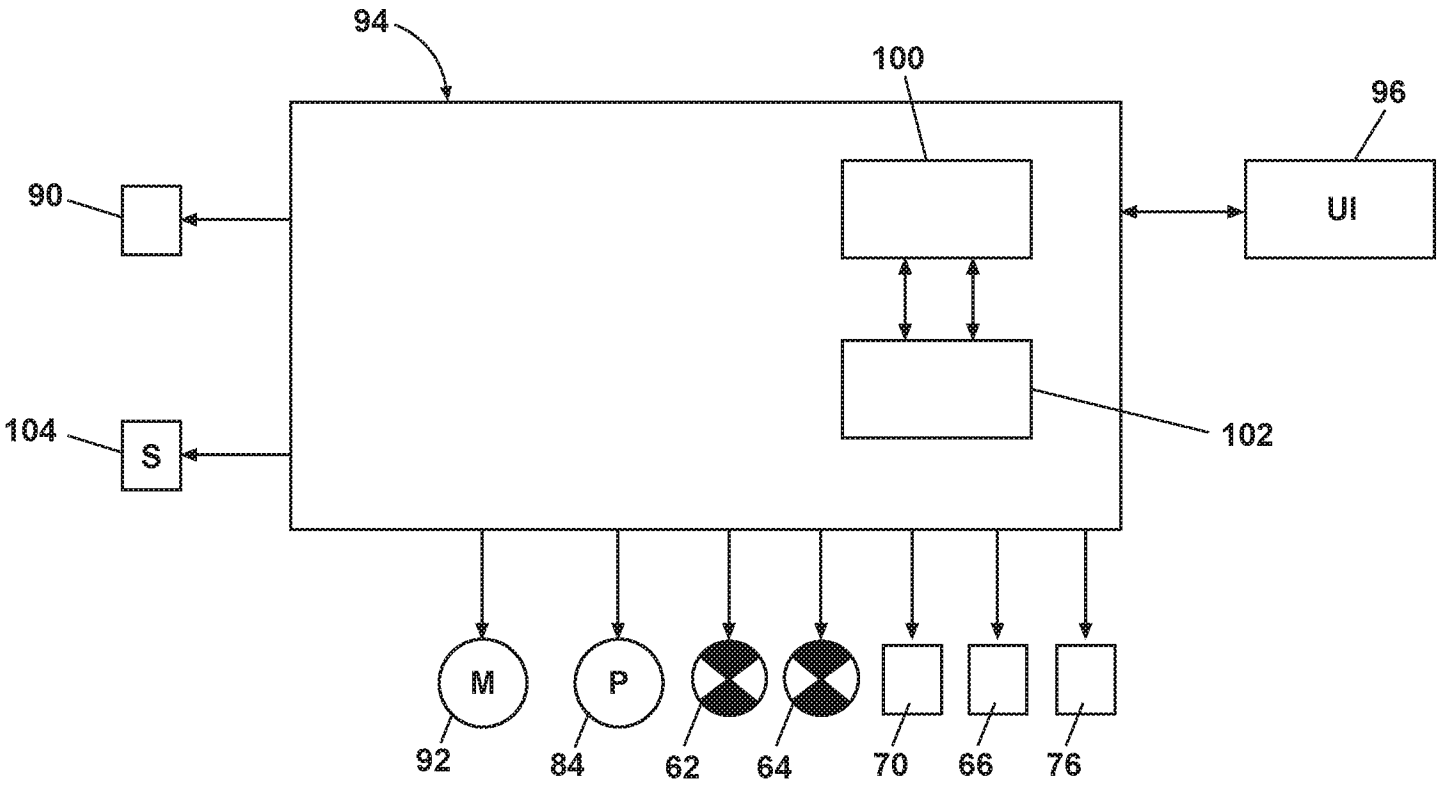
FIG. 2 is a schematic of a control system of the laundry treating appliance of FIG. 1.

Referring to FIG. 2, the controller 94 can be provided with a memory 100 and a central processing unit (CPU) 102. The memory 100 can be used for storing the control software that is executed by the CPU 102 in completing a cycle of operation using the laundry treating appliance 10 and any additional software. Examples, without limitation, of cycles of operation include: wash, heavy duty wash, delicate wash, quick wash, pre-wash, refresh, rinse only, and timed wash.

The controller 94 can be operably coupled with one or more components of the laundry treating appliance 10 for communicating with and controlling the operation of the component to complete a cycle of operation. For example, the controller 94 can be operably coupled with the motor 92, the pump 84, the liquid manifold 66, the water dispenser 70, the dispenser 76, the sump heater 90 which can be provided throughout the laundry treating appliance 10 to implement the operation of these and other components to implement one or more of the cycles of operation. Additional instruction or communication can be sent to or received from a user through the user interface 96.

The controller 94 can also be coupled with one or more sensors 104 provided in one or more of the systems of the laundry treating appliance 10 to receive input from the sensors, which are known in the art and not shown for simplicity. Non-limiting examples of sensors 104 that can be communicably coupled with the controller 94 include: a treating chamber temperature sensor, a moisture sensor, a weight sensor, a chemical sensor, a position sensor and a motor torque sensor, which can be used to determine a variety of system and laundry characteristics, such as laundry load inertia or mass. One particular sensor can be a position sensor to determine whether the removable basket assembly 38 is positioned within the laundry treating appliance 10. Another particular sensor can be a flow meter, which can be used to measure and control the amount of water filling the removable basket assembly 38. The flow meter could minimize or prevent the occurrence of water leaving the removable basket assembly 38 during the filling phase, and minimize contamination potential with the first basket 18. Yet another particular sensor can include a sensor for determining the presence of the removable basket assembly 38. Additionally, detection of the removable basket assembly 38 can be detected in a manner disclosed in U.S. Pat. Pub. No. 2016/0201243 to Bergamo, filed Oct. 23, 2015, now U.S. Pat. No. 9,777,419, issued Oct. 3, 2017, entitled "Detection System of Washing Machines Removable Basket and Method for Detection of Washing Machines Removable Basket," which is herein incorporated by reference in full. For example, the sensor can automatically sense a presence of the second basket within the first basket and output a configuration signal based thereon. In this manner the input indicative of the selectable configuration can be received from the sensor.

The laundry treating appliance 10 can be operated with both the first basket 18 and the second basket 22, simultaneously, or can be operated with either the first basket 18 or the second basket 22 individually. When executing a cycle of operation within the first basket 18 without the removable basket assembly 38, the second basket 22, including the transmitter 34, can be removed from the laundry treating appliance 10. When using the removable basket assembly 38 alone, laundry articles need to be provided only in the second basket 22. In such an organization, the removable basket assembly 38 mounts on the first clothes mover 28. Rotational or reciprocating movement of the first clothes mover 28 is transferred to the second clothes mover 36 via the transmitter 34. When using both the first and second baskets 18, 22, the first basket 18 can be filled with laundry articles, then the removable basket assembly 38 installs over the first treating chamber 20, and the second basket 22 is filled with additional laundry articles. The reverse of the aforementioned process can be used to remove laundry articles after a cycle of operation has completed.

In operation using both the removable basket assembly 38 and the first basket 18, treating chemistry can be provided in one or more of the dispensers 44, 46, 76, to treat the laundry articles according to a desired cycle of operation. A user can select a cycle of operation on the user interface 96, such as a standard wash cycle of operation. Different cycles of operation can be tailored to different or individual treating chambers, as well as different organizations, such as with or without the removable basket assembly 38. Water can fill the first basket 18 dispensed from the second outlet 74 and passing to fill the tub 14, and then filling the first basket 18 through the perforations 26. Water can simultaneously fill the second basket 22 dispensed from the first outlet 72 of the water dispenser 70. Detergent can be dispensed into the first treating chamber 20 from the dispenser 76 in the liquid manifold 66 and can be dispensed into the second treating chamber 24 from the dispensers 44, 46 on the upper ring 40. The first and second clothes movers 28, 36 can agitate the articles within the first and second treating chambers 20, 24, respectively. Rotational or reciprocating movement of the first clothes mover 28 is translated to the second clothes mover 36 via the transmitter 34. After completion of the wash cycle, the liquid can drain from the first treating chamber 20 into the tub 14. The motor 92 can then rotate the first basket 18 and impart rotational movement to the second basket 22. The rotational movement of the second basket 22 can drive liquid within the second basket 22 outward and upward toward the outlets 42, where water can drain over the balance ring 30 and into the tub 14 exterior of the first basket 18. The liquid can drain from the laundry treating appliance 10 through the drain conduit 86. A rinse cycle can then begin, refilling both the first and second treating chambers 20, 24 in the same manner as the wash cycle. The water can be again drained and a spin cycle can begin. Rotational movement is transferred from the motor to the second basket 22 via the first basket 18. Liquid can drain from the first and second treating chamber 20, 24 in the same manner as draining the wash cycle. As such, the first and second treating chambers 20, 24 can treat two individual loads of articles separately, but simultaneously.

Alternatively, the second basket 22 can be used alone. The operation can be similar to that described above, without filling, draining, or treating any articles within the first treating chamber 20. Rotational or reciprocating movement is still imparted to the first basket 18 and the first clothes mover 28, which is transferred to the second basket 22 and the second clothes mover 36, respectively, in order to treat articles in the second basket 22.

Alternatively, the first basket 18 can be used alone. The removable basket assembly 38 can be removed and the first basket 18 can treat a load of laundry in a manner similar to that of a traditional laundry treating appliance 10. In yet another alternative, the removable basket assembly 38 can remain on top of the first basket 18, and the first treating chamber 20 can be used to treat a load of laundry articles while carrying the removable basket assembly in a manner described above, without the steps involved with treating articles within the second basket 22.

Figure 3:
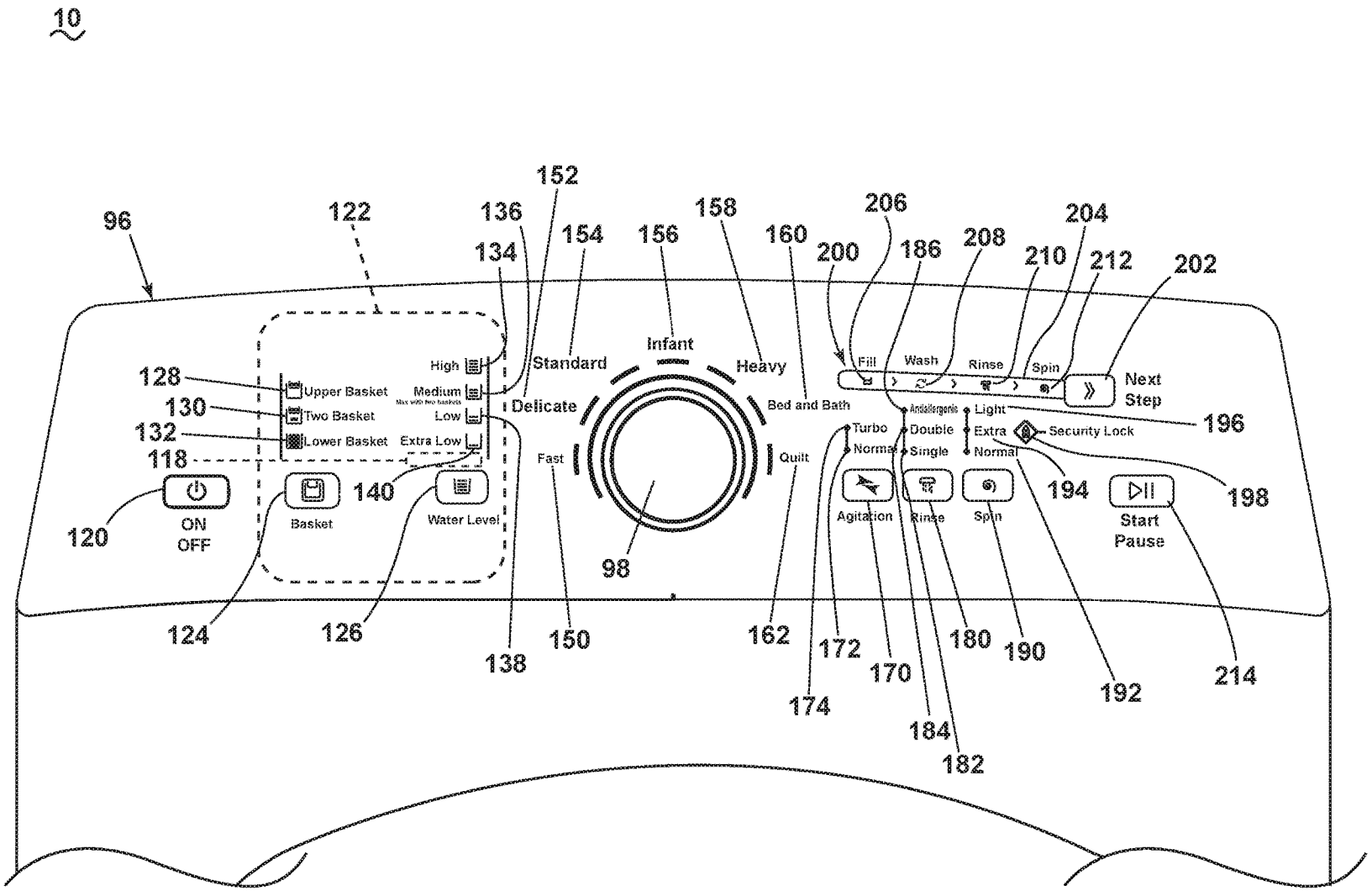
FIG. 3 is a front view of a user interface for operating the laundry treating appliance of FIGS. 1 and 2, including a basket control selection.

Referring now to FIG. 3, the user interface 96 can include one or more controls permitting the user to operate the laundry treating appliance 10 according to a cycle of operation. A power button 120 can provide for selectively turning the laundry treating appliance 10 on or off. A basket control section 122 can include a basket modifier button 124 and a water level button 126. The basket modifier button 124 can be linked to three exemplary basket selection indicators, illustrated as an upper basket indicator 128, a dual basket indicator 130, and a lower basket indicator 132, representative of three different selectable configurations or configuration types including treating laundry articles in only the second basket 22, treating laundry articles in both baskets, 18, 22, or treating laundry articles in only the first basket 18, respectively. Indicator as used herein means any communication medium to communicate with a user, such as a visual indicator or audible indicator. Actuation of the basket modifier button 124 can cycle through the indicators 128, 130, 132 and the three different selectable configuration types. In one non-limiting example, treating laundry articles in the first basket only can be a default selectable configuration, illuminating the lower basket indicator 132.

Similarly, the water level button 126 can be linked to four options for water level indicators, illustrated as a high water level indicator 134, a medium water level indicator 136, a low water level indicator 138, and an extra low water level indicator 140. The medium water level indicator 136 can be the maximum water level for use with both baskets 18, 22. Actuation of the water level button 126 can cycle through selectable options of the indicators 134, 136, 138, 140 via illumination of the indicators 134, 136, 138, 140. The water level indicators 134, 136, 138, 140 can be representative of user-selectable options for selecting water level treatment variables for the laundry treating appliance. The high water level indicator 134 can be indicative of a maximum amount of water used for a cycle of operation without the removable basket assembly 38. The medium water level indicator 136 can be representative of a medium amount of water and can be the maximum amount of water used for a cycle of operation in the first basket 18 including the removable basket assembly 38. The low water level indicator 138 can be representative of a small amount of water for a small load. The extra low water level indicator 140 can be representative of a very small amount of water, which can be used to rinse the first basket 18 after draining the second basket 22.

The water level button 126 can be used to select the user selectable option, such as water level. A selected option can be representative of a user selectable variable communicated to the controller 94 of FIG. 2. The controller can implement the cycle of operation based upon input of the user selected variable. The user-selected variable can include the water level as represented by the water level indicators 134, 136, 138, 140. Illumination of one or more indicators can indicate the currently selected user selected variable, which is communicated to the user in executing a desired cycle of operation. Additionally or alternatively, other visual or audible indicators, such as buzzing or blinking, are contemplated in communicating the user selectable options to the user. For example, if none of the water levels are selectable, an audible beep can be provided. Additionally, other communication is contemplated, such as haptic feedback or remote messaging in non-limiting examples.

The knob 98 can be linked to differing cycles of operation, such as a fast cycle, a delicate cycle, a standard cycle, a children's clothing cycle, a heavy cycle, a bed and bath cycle, or a quilt cycle, represented by a fast indicator 150, a delicate indicator 152, a standard indicator 154, a children's clothing indicator 156, a heavy indicator 158, a bed and bath indicator 160, and a quilt indicator 162, respectively. Rotating actuation of the knob 98 can be used to select the cycle of operation, indicated by illumination of the different indicator. It should be understood that the indicators and cycles of operation are by way of example only, and should not be understood as limiting as shown.

An agitation button 170 can be included on the user interface 96. A normal indicator 172 and a turbo indicator 174 can be linked to the agitation button 170, such that actuation of the agitation button 170 can selectively illuminate either indicator 172, 174 representative of the level of agitation to use in the particular cycle of operation.

A rinse button 180 can also be included on the user interface 96. A single indicator 182, a double indicator 184, and an antiallergenic indicator 186 can be linked to the rinse button 180. Actuation of the rinse button 180 can selectively illuminate the single, double, or antiallergenic indicators 182, 184, 186 representative of the particular type of rinse to use during the selected cycle of operation.

A spin button 190 can also be included on the user interface 96. A normal indicator 192, an extra indicator 194, and a light indicator 196 can be linked to the spin button 190 such that actuation of the spin button 190 can selectively illuminate the normal, extra, or light indicators 192, 194, 196 representative of the spin to be used with the particular cycle of operation. A security lock indicator 198 can be included near the spin indicators, which can be illuminated to indicate that the door is locked during the spin cycle of the cycle of operation.

A status indicator 200 can be included on the user interface 96 having a next button 202. The status indicator 200 can include an illuminable timeline 204, having different timeline representations, including a fill indicator 206, a wash indicator 208, a rinse indicator 210, and a spin indicator 212. During progression of the cycle of operation, different indicators as part of the illuminable timeline 204 can be illuminated to indicate the current status of the cycle of operation. The next button 202, for example, can be used to force progression of the cycle of operation to the next step, and such forced progression can be represented by the illuminable timeline 204.

A start or pause button 214 can be included on the user interface 96, which can be actuable to selectively start the cycle of operation or to pause the cycle of operation.

It should be appreciated that the user interface 96, the cycles of operation, and the particular options generally listed on the user interface 96 are exemplary, and any organization or replacement of known functionalities can be included on the user interface 96. Similarly, any such user interface is contemplated, including but not limited to, buttons, knobs, switches, touch screens or the like.

During selection of a cycle of operation, a user can press the power button to activate the user interface 96. A standard set of lights can illuminate, such as those representative of a standard wash. The user can then rotate the knob to select the desired cycle of operation to treat the articles within the laundry treating apparatus 10. In one non-limiting example, the user can select the standard wash, illuminating the standard indicator 154. Under the standard wash, the normal indicator 172 for the agitation, the single indicator 182 for the rinse, and the normal indicator 192 for the spin can be illuminated. The user can choose to push any of the agitation button 170, the rinse button 180, or the spin button 190 to deviate from the standard wash settings, and such changes can be reflected in the related indicators.

The user can then actuate the basket modifier button 124 to select the baskets appropriate to the configuration type for the laundry treating appliance 10 to be used for the cycle of operation. For example, if the user were using both the first and second baskets 18, 22, the user can actuate the basket modifier button 124 to illuminate the dual basket indicator 130. Next, the user can actuate the water level button 126 to select a user-selectable water level. After selecting the desired aspects of the cycle of operation, the user can actuate the start button 220 to begin the cycle of operation. The user can monitor progress with the illuminable timeline 204, or can accelerate progression with the next button 202 until the cycle of operation has completed.

Figure 4:
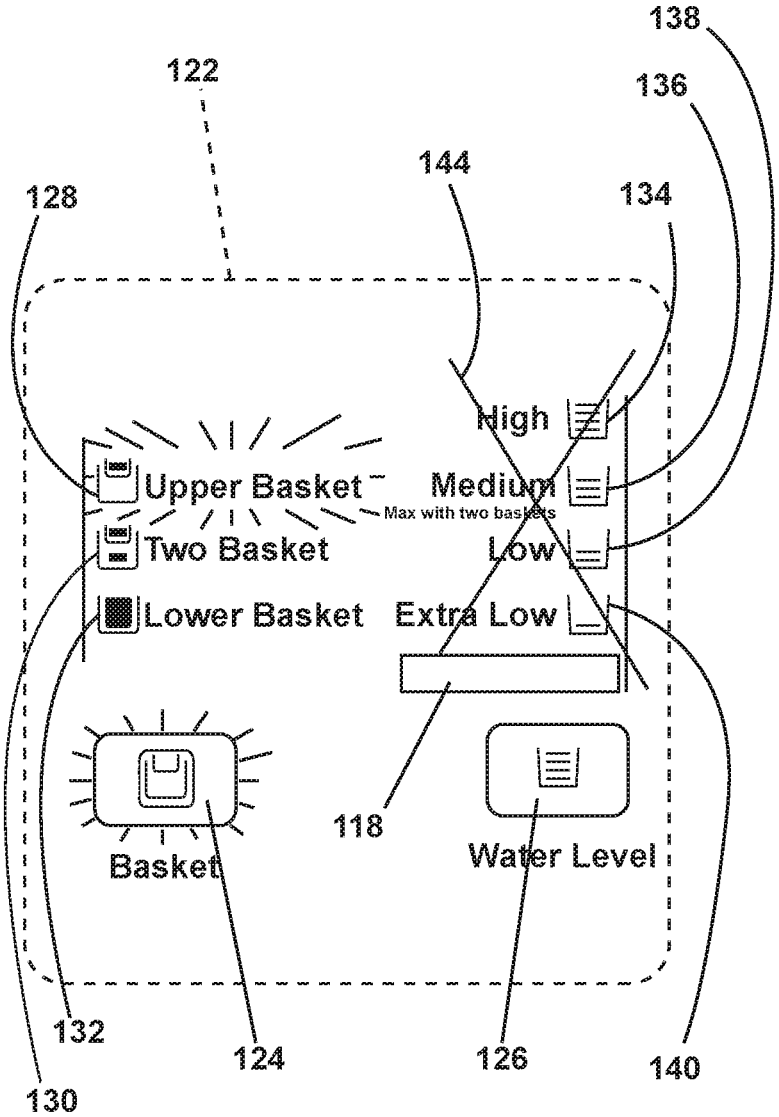
FIG. 4 is an enlarged view of the basket control selection of FIG. 3 having an upper basket indicator illuminated, and having unselectable water level options.

It can be desirable or necessary to include some restrictions on functionality of the user interface 96 in controlling the cycle of operation, as some selections can conflict with one another. For example, utilizing a configuration type including the second basket 22 with a high water level can result in spilling of the water as the second basket 22 occupies a portion of the first treating chamber 20. Such restrictions can be reflected in operability of the user interface when selecting particular configuration types. For example, FIG. 4 illustrates an isolated view of the basket control section 122 and illustrates one such restriction. The user can actuate the basket modifier button 124 to select the upper basket indicator 128. The water level indicators 134, 136, 138, 140 can become unilluminated and inaccessible as represented by the "X" 144. The "X" 144 does not appear on the user interface 96, but is illustrative to show that the indicators are unavailable for selection. The selection of the upper basket indicator 128 can display limited user-selectable options representative of available treatment variables available to the user. User selectable options can include a preset with a predetermined amount of selectable options that are available to the user. The preset including the amount of selectable options can be determined by a particular cycle of operation, or a configuration of the laundry treating appliance 10, in non-limiting examples. The configuration of the laundry treating appliance 10 can include, for example, use with or without the removable basket assembly 38. The preset can include any number of user selectable options, including no selectable options.

Optionally, the water level button 126 can be unilluminated to indicate that it is presently inoperable or unselectable. If the user attempts to use the water level button 126, a noise feedback can be provided to the user to inform the user of an erroneous selection.

A virtual indicator 118 can be selected by the controller 94 indicative of no-water level (as no water is provided to the first basket 18). The term virtual indicator as used herein is a digital indication, such as within a software program, representative of a selection determining of a condition of a cycle of operation this is not indicated on the user interface. The virtual indicator can be representative of a null water value for no water, further represented by the lack of illumination of the remaining indicators. Specifically, the lack of illumination of the water level indicators 134, 136, 138, 140 indicates to the user that no water is being added to the first basket 18. If the user actuates the basket modifier button 124 to illuminate another basket indicator 130, 132, the water level indicators 134, 136, 138, 140 can become available indicative of selectable water levels based upon the new basket selection.

With limiting selection of the water level, incorrect water level selection is prevented and water waste is minimized. Additionally, the user interface 96 provides an intuitive interaction for the user, which is desirable for a user. However, without any water provided in the first basket 18, drainage of the second basket 22 can cause some residual residue in the first basket 18 as well as any area the liquid is recirculated to. Additionally, if something remains in the first basket 18, such as clothing remaining from a previous load, there is a risk of damage to the clothing in the first basket 18 at subsequent operation of the second basket 22 according to the cycle of operation.

Figure 5:
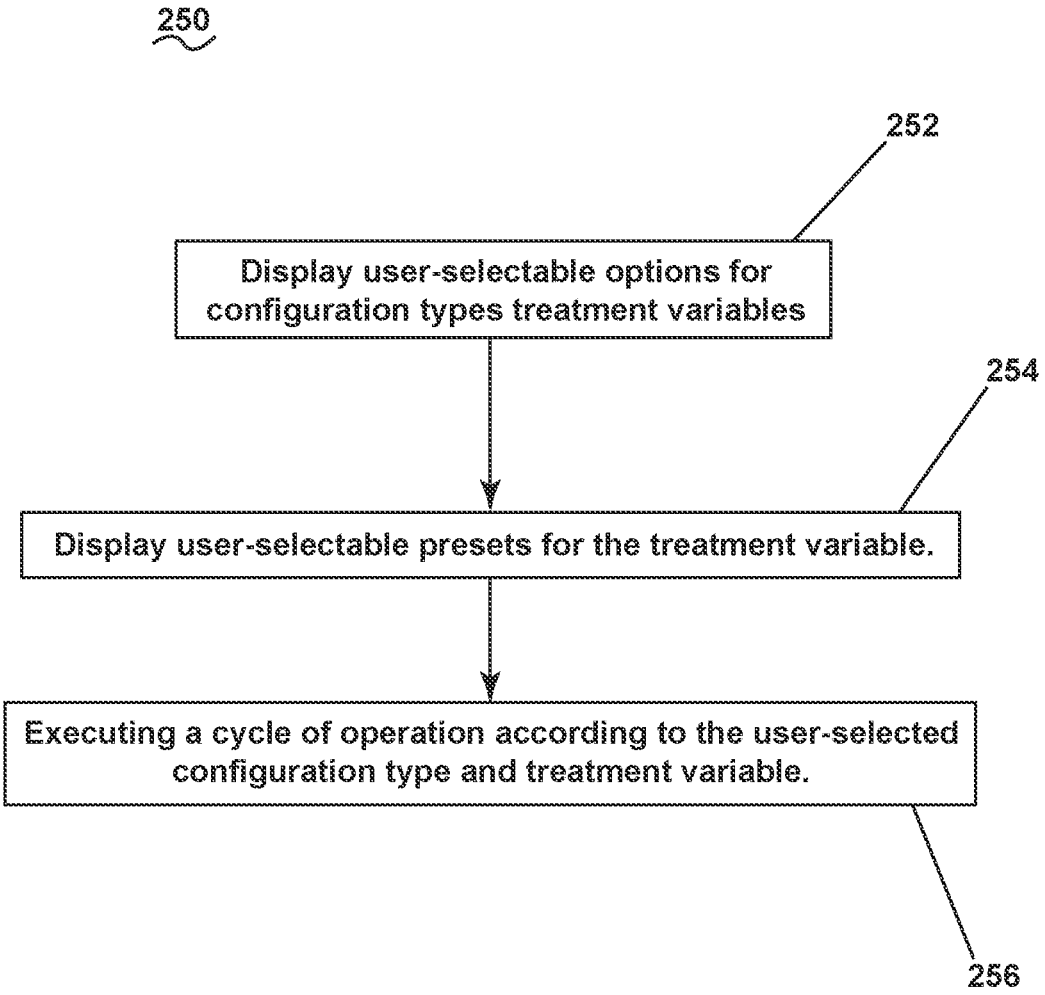
FIG. 5 is a flow chart illustrating a method displaying selection information on a user interface of a laundry treating appliance.

Referring now to FIG. 5, a method 250 is shown for displaying selection information on a user interface of a laundry treating appliance wherein the laundry treating appliance includes a first basket defining a first treating chamber for receiving laundry for treatment and a second basket selectively receivable within at least a portion of the first treating chamber, the second basket defining a second treating chamber for receiving laundry for treatment. The laundry treating appliance can be the laundry treating appliance 10 as described in FIG. 1, by way of non-limiting example. The user interface can be the user interface 96 of FIGS. 1-4. The first and second baskets can be the first and second baskets 18, 22 of FIG. 1 and the first and second treating chambers can be the first and second treating chambers 20, 24 of FIG. 1. The laundry treating appliance is customizable by a user to operation in one of multiple configuration types.

The method 250 can include, at 252, displaying on the user interface, user-selectable options for configuration types and at least one treatment variable. The user-selectable options for configuration types can include the second basket alone, both baskets, or the first basket alone, represented by the upper, dual, and lower basket indicators 128, 130, 132 representative of the first, second, and third configuration types, respectively. The treatment variables can include water level, such as a high water level, a medium water level, a low water level, and an extra low water level, which can be represented by the high, medium, low, and extra low water level indicators 134, 136, 138, 140 of FIGS. 3 and 4.

The method 250 can further include, at 254, in response to receiving user selection for the configuration type, displaying on the user interface user-selectable options for the at least one treatment variable. Such user-selectable options can be determined by the selected configuration type and can have full, limited, or on functionality based upon the selected configuration type. In one example, none of the user-selectable options are available, represented by unselectability of any of the treatment variables and darkening of the related indicators. An attempt to select one of the user-selectable options when none are available can include a noise feedback to the user to communicate an unavailable selection.

The method 250 can further include, at 256, in response to receiving a user selection from the user-selectable options, executing a cycle of operation according to the user-selected configuration type and the at least one treatment variable. The laundry treating appliance can execute the cycle of operation in accordance with the configuration type and the user-selectable options, which can be determined or limited by the particular configuration type. Executing the cycle of operation can further include providing an indication related to the at least one treatment variable. Such provision of an indication can include illumination of none, or one or more of the water level indicators 134, 136, 138, 140 representative of a user-selected treatment variable. Alternative indications can include noise or other feedback communicable to the user.

Figure 6:
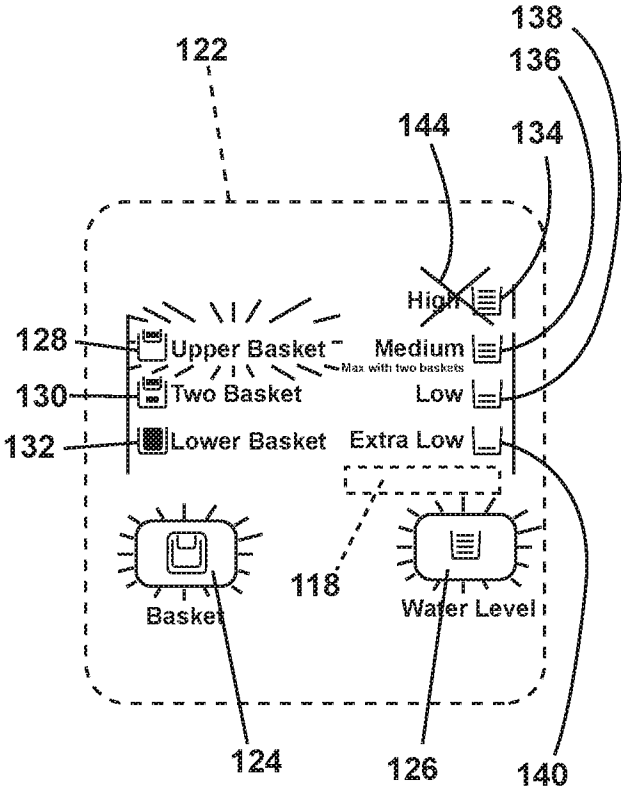
FIG. 6 is a view of an alternative basket control selection having an upper basket indicator illuminated, and having an unselectable high water level.

Referring now to FIG. 6, an alternative functionality for the basket control section 122 is shown and includes that the basket modifier button 124 is actuated to illuminate the upper basket indicator 128, selecting a configuration type representative of the second basket 22. The high water level indicator 134 is unavailable represented by the "X" 144. The "X" 144 does not appear on the user interface 96, but is illustrative to show that the indicators are unavailable for selection. The water level button 126 is illuminated and actuable. Actuation of the water level button 126 can cycle through the remaining water levels as represented by the indicators 136, 138, 140. When a user attempts to actuate the water level button 126 to select the high water level indicator 134, the selection illumination can skip over the high water level indicator 134, such as from the medium water level indicator 136 to the extra low water level indicator 140, or vice versa. Similarly, if the user attempts to select the high water level indicator 134, a noise or other feedback can be sounded or provided to the user to inform them that the selection is unavailable.

Preventing selection of the high water level indicator 134 during use of the second basket 22 prevents excess water from being provided to the first basket 18 which is at least partially occupied by the upper, second basket 22, which can prevent spilling or overflowing, which can otherwise damage the laundry treating appliance 10 or the area surrounding the laundry treating appliance 10.

Figure 7:
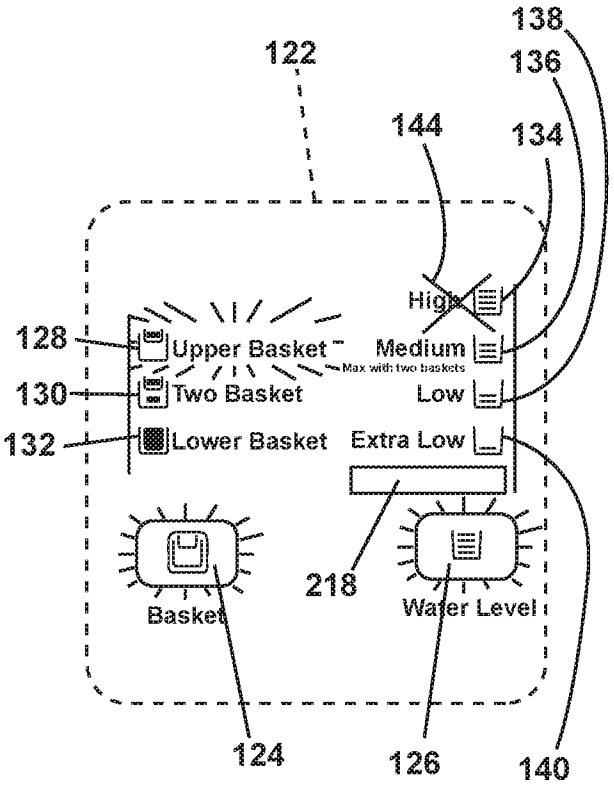
FIG. 7 is a view of another alternative basket control selection having an upper basket indicator illuminated, having an unselectable high water level, and including a virtual indicator.

Referring now to FIG. 7, an alternative functionality for the basket control selection 122 can be substantially similar to the basket control selection of FIG. 6, except that the virtual indicator 118 is selectable by the controller 94. Actuation of the water level button 126 can cycle through the remaining medium, low, extra low, or no water variables, illuminating the medium water level indicator 136, the low water level indicator 138, the extra low water level indicator 140, or selecting the virtual indicator 118, respectively. Selection of the high water level indicator 134 is unavailable. The virtual indicator 118 provides for the illumination of none of the water level indicators 134, 136, 138, 140, which again can indicate that no water will be provided to the lower, first basket during the cycle of operation.

The basket control selection 122 permits selection of at least some water level in the lower, first basket, or no water level at all, while preventing an excessive, high amount of water as the high water level indicator 134, which can cause overflowing or damage to the laundry treating appliance or the surrounding area. Selection of any water level can inform the user that at least some water will be wasted, or provide a suggestion to use no water. Such information can be displayed or audibly communication, in non-limiting examples.

Figure 8:
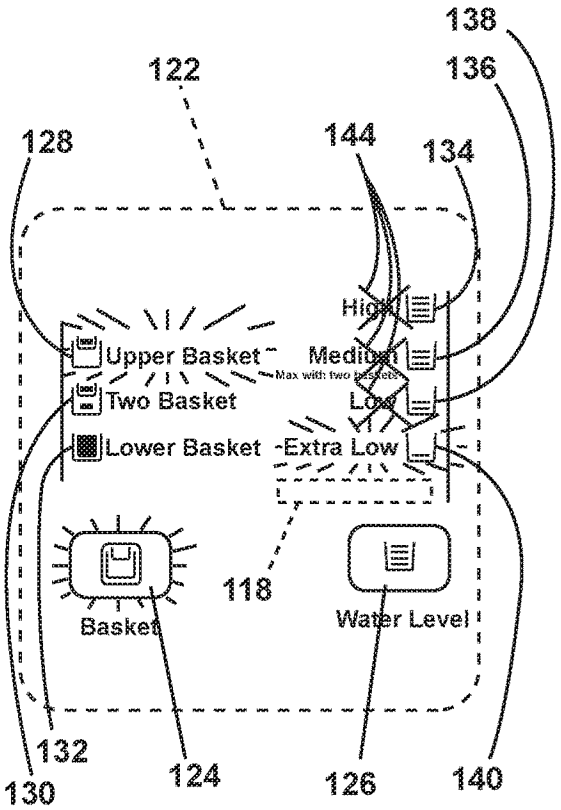
FIG. 8 is a view of another alternative basket control selection having an upper basket indicator illuminated, having unselectable water level options, and having an extra low water level indicator illuminated.

Referring now to FIG. 8, an alternative functionality for the exemplary basket control selection 122 is illustrated including the high water level indicator 134, a medium water level indicator 136, and a low water level indicator 138 having the "X" 144 over them, indicating unavailability.

The basket modifier button 124 can be actuated to select the second basket 22, illuminating the upper basket indicator 128 as the configuration type. Upon selection of the second basket 22, only the extra low water level variable is available, and the extra low water level indicator 140 is illuminated. The high, medium, and low water level indicators 134, 136, 138 are unavailable for selection, as indicated by the "X" 144 over them. The "X" 144 does not appear on the user interface 96, but is illustrative to show that the indicators are unavailable for selection. As such, when operating only the second basket 22, the user is limited to utilizing the extra low water level in the first basket 18, which minimizes risk of residual treating chemistry in the liquid supply system and the first basket 18. Additionally, the risk of damage to any remnant laundry articles in the first basket 18 is reduced. However, there is at least some water used in the first basket 18 beyond what is required for the second basket 22 alone, providing at least some minimal water waste.

Figure 9:
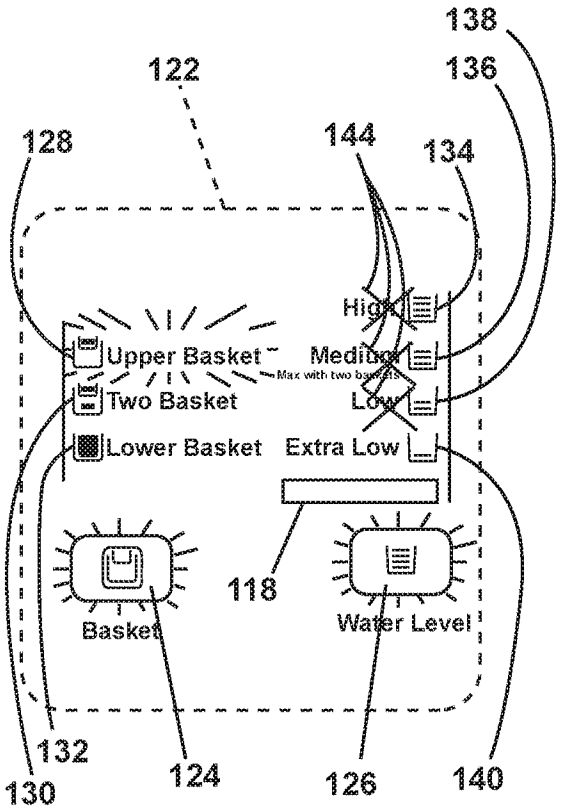
FIG. 9 is a view of another alternative basket control selection having an upper basket indicator illuminated, having unselectable water level options, and having a virtual indicator.

Referring now to FIG. 9, another alternative functionality for the basket control selection 122 can be substantially similar to the basket control selection of FIG. 8 except that the virtual indicator 118 and extra low water level indicator 140 are selectable. The user can actuate the water level button 126, to select either the extra low water setting, illuminating the extra low water level indicator 140, or illuminating no water level indicator, representing the virtual indicator 118 indicating that no water will be used in the first basket 22. The virtual indicator 118 provides the user increased selection, which can provide for using less water during the cycle of operation. As such, the user can have increased options to use no water to save water, or to use minimal water to minimize residue in the unused portions of the laundry treating appliance.

Figure 10:
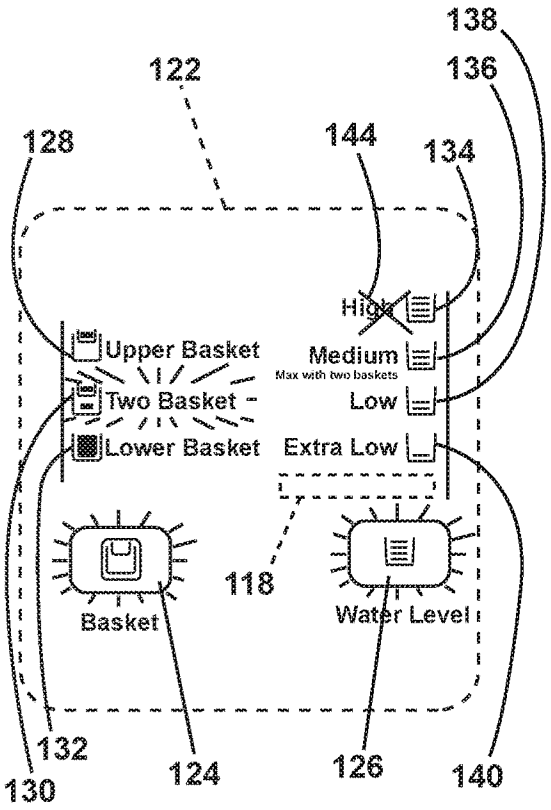
FIG. 10 is a view of another alternative basket control selection having a dual basket indicator illuminated, and having an unselectable high water level.

Referring now to FIG. 10, another alternative functionality for the basket control selection 122 includes the basket modifier button 124 has been actuated to select the dual basket configuration type utilizing both the first and second baskets 18, 22. The dual basket indicator 130 is still illuminated. The "X" 144 has been placed over the high water level indicator 134 to indicate unavailability of the indicator 134. The user can actuate the water level button 126 to cycle through the medium, low, and extra low water level indicators 136, 138, 140 to select treatment variable representative of the amount of water to be provided in the first basket 18 while running a cycle of operation including both the first and second basket 18, 22. Preventing selection of the high water level treatment variable prevents overfilling of the first basket 18, which can lead to spilling of the water.

Figure 11:
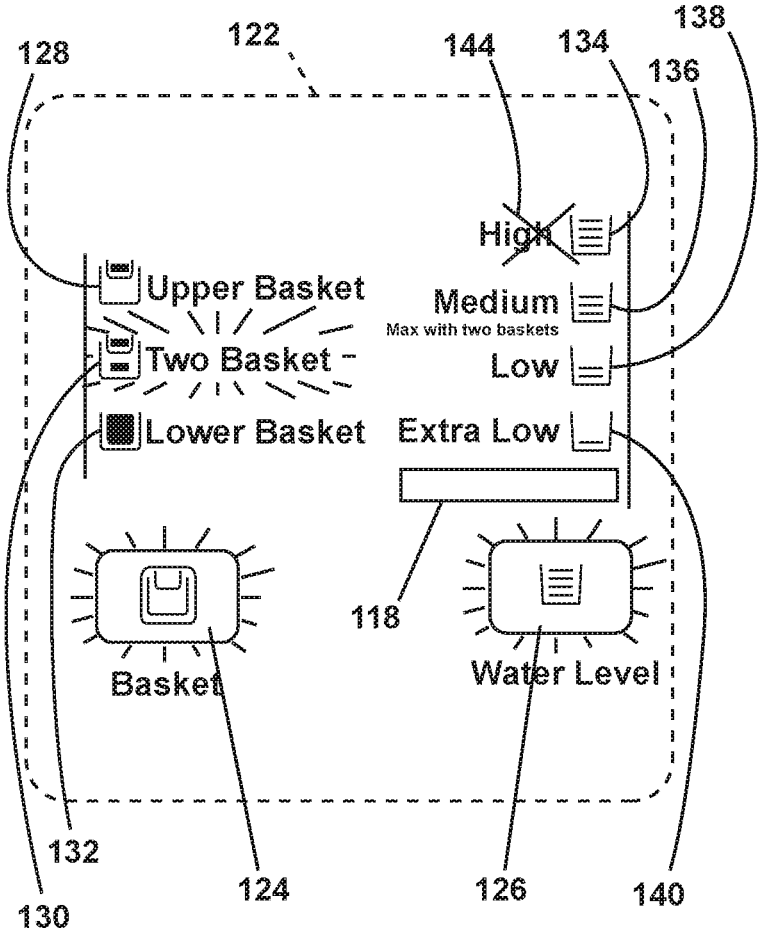
FIG. 11 is a view of another alternative basket control selection having a dual basket indicator illuminated, having an unselectable high water level, and having a virtual indicator.

Referring now to FIG. 11, another exemplary basket control selection 122 can be substantially similar to the basket control selection 122 of FIG. 10 except that the virtual indicator 118 is available for the controller 94 to select no water level. The user can actuate the water level button 126 to cycle through the medium water level indicator 136, the low water level indicator 138, and the extra low water level indicator 140, as well as the virtual indicator 118 indicating no water to select a treatment variable or option. The high water level indicator 134 is unavailable and unselectable, as indicated by the "X" 144. The "X" 144 does not appear on the user interface 96, but is illustrative to show that the indicators are unavailable for selection. Prevention of selection of the high water level treatment variable prevents excess filling of water in the first basket 18, which can lead to spilling or damage to the laundry treating appliance. Providing the ability to select the virtual indicator 118 for no water improves functionality and operability for the user, but may lead to the user selecting no water in the first basket 18, although clothing is provided in the first basket 18 intended for treatment according to a cycle of operation.

Figure 12:
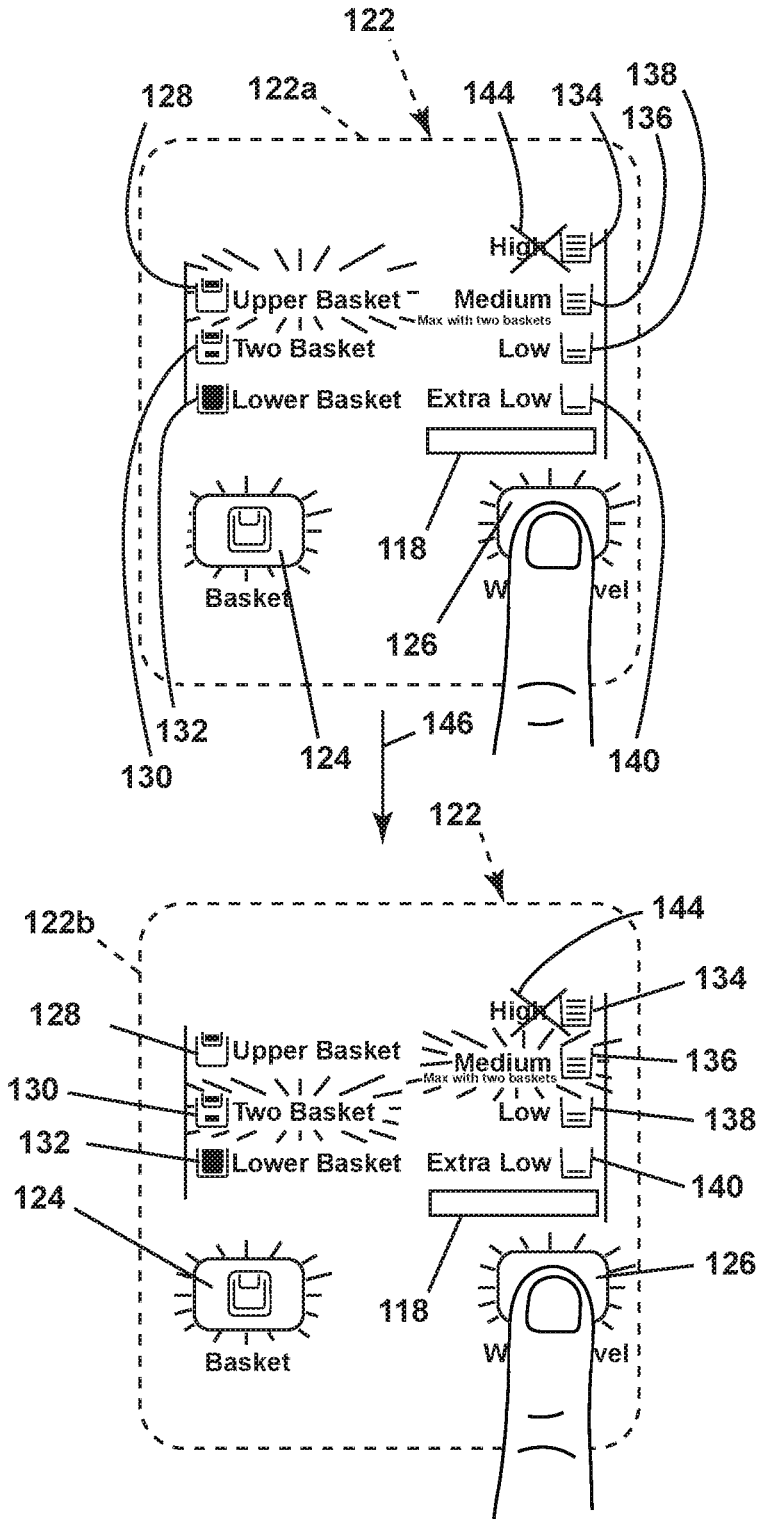
FIG. 12 is a view of a first alternative basket control selection having an upper basket indicator illuminated, and having a user actuate a water level button to trigger a second alternative basket control selection having a dual basket indicator illuminated, with an unselectable high water level, and a medium water level indicator illuminated.

Referring now to FIG. 12, another exemplary basket control selection 122 can include a user attempting to select the high water level indicator 134 while using the upper basket 22. At selection of the upper basket 22, the high water level indicator 134 is unselectable, illustrated by the "X" 144 over the indicator 134. When the user attempts to select the high water level indicator 134, the basket selection can move from the upper basket 128 to two baskets 130. As such, the configuration type can automatically change from the second basket 22 alone to both the first and second baskets 18, 22. Additionally, the medium water level indicator 136 becomes illuminated, indicating a change in treatment variable, while the high water level indicator 134 is still unselectable, represented by the "X" 144. An audible response, such as a buzzing noise or voice explanation, can be generated to indicate to the user that the configuration type has changed. Similarly, a visual indication can be presented to the user, such as flashing of the dual basket indicator 128 to further communicate the change in both the configuration type and treatment variable to the user.

When the user is using the second basket 22 configuration type, the user is limited to using less water than the high water level. If the user wants to use more water in the first basket 18, they must select a different configuration type, such as the dual baskets 18, 22, or just the first basket 18 to prevent unnecessary wasting of water. Attempted selection of the high water level will automatically change the selected configuration type to one that is available.

Figure 13:
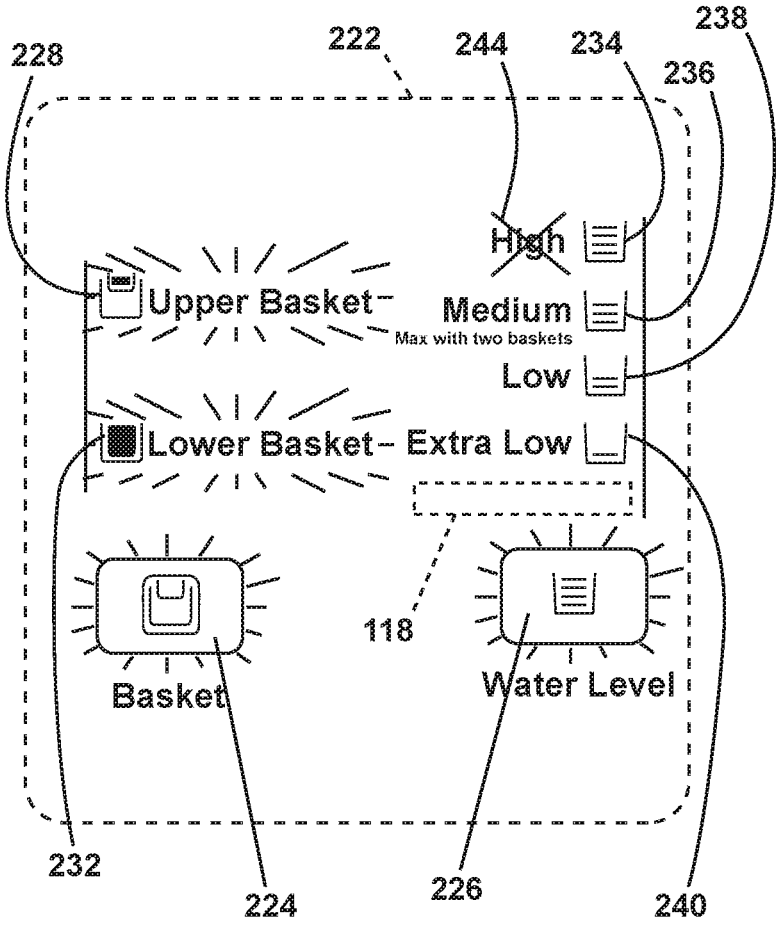
FIG. 13 is a view of yet another alternative basket control selection having both an upper and lower basket indicator illuminated, and having an unselectable high water level.

Referring now to FIG. 13, another exemplary basket control selection 222 can be substantially similar to the basket control selection 122 of FIGS. 3-12. As such, similar numerals will be used to describe similar elements, and the discussion will be limited to differences between the two; specifically that the dual basket indicator 128 has been removed.

The user can actuate a basket modifier button 224 to cycle between either an upper basket indicator 228, a lower basket indicator 232, or both, as shown in FIG. 13, representing that both the second basket 22 and the first basket 18 of FIG. 1 can be utilized as the configuration type. It should be understood that when both the upper and lower basket indicators 228, 232 are illuminated, the user has selected the dual basket configuration to operate both the first and second baskets 18, 22 of FIG. 1. The availability of the water level indicators 234, 236, 238, 240 representing the treatment variable can be determined based upon the basket selection, similar to that as described in FIGS. 4-12. For example, when utilizing both the second basket 22 and the first basket 18, illuminating both the upper basket indicator 228 and the lower basket indicator 232, the high water level indicator 234 can be unavailable, indicated by an "X" 244, to prevent overfilling of the first basket 18.

Figure 14:
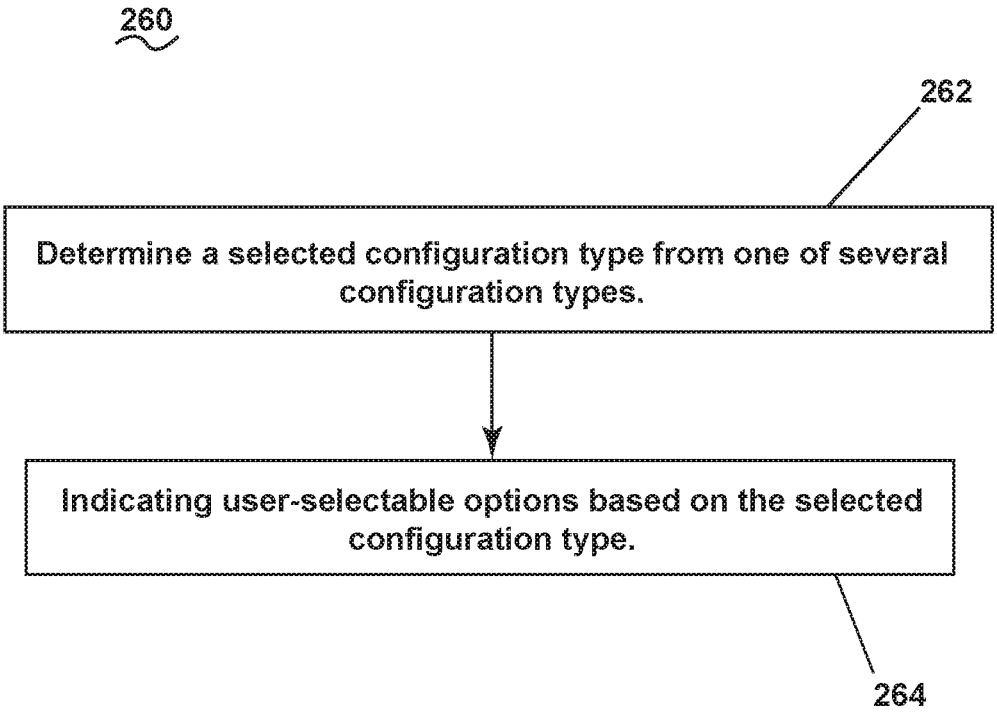
FIG. 14 is a flow chart illustrating an alternative method of displaying selection information on a user interface of a laundry treating appliance.

Referring now to FIG. 14, an alternative method 260 for displaying information on a user interface of a laundry treating appliance that is customizable by a user to operate in one of multiple configuration types can include, at 262, determining, via input on a user interface, a selected one of the multiple configurations that include a first configuration where laundry is treated in a first basket, a second configuration where laundry is treated in the second basket at least partially located in the first basket, and a third configuration where laundry is treated in the first basket and the second basket. Determining the selected one of the multiple configuration types can include receiving a user selected input on the user interface. For example, a user can actuate the basket modifier button as described herein to determine a configuration type. Determining the selected one of the multiple configuration types can further include defaulting to a configuration type where a main basket is utilized, such as the lower, first basket as described herein.

The method 260 can further include, at 264, indicating user-selectable options for water level based on the selected one of the multiple configuration types. In one example, the user can select the second configuration type to just the upper, second basket and the user-selectable options can include a water level including an extra low, a low, and a medium water level. One additional user-selectable option can include none or no water level. Furthermore, indicating user-selectable options can include generating a noise to indicate to the user either a change in user-selectable options or the unavailability of a user-selectable option. A change in the configuration type can prompt a change in the user-selectable options, which can be communicated to the user through a noise. Similarly, an attempt by the user to make a selection that is unavailable can be met with a noise to communicate an attempt that is unavailable.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating appliance, comprising:

a first basket having a first open top and defining a first treating chamber for receiving laundry for treatment;

a second basket having a second open top and selectively receivable within at least a portion of the first treating chamber, the second basket defining a second treating chamber for receiving laundry for treatment;

a liquid supply system for selectively supplying water to the first basket, the second basket, or both of the first and second baskets;

a user interface comprising a basket modifier interface, a water level interface, a virtual indicator and a cycle of operation interface configured to receive input from a user and provide output to the user;

wherein the water level interface comprises a water level button configured to allow a user to select one of four water level options including a high water level option, a medium water level option, a low water level option, and an extra low water level option, wherein the medium water level option is a maximum amount of water that can be used in a cycle of operation when the user has selected the basket modifier interface to treat laundry in both the first basket and the second basket; and a controller operably coupled with the liquid supply system and the user interface and wherein the controller is configured to receive an input from the cycle of operation interface indicative of a desired cycle of operation and configured to receive an input from the basket modifier interface and based on the input from the cycle of operation interface and the basket modifier interface, illuminate the selected basket modifier interface and unilluminate the unselectable options on the water level interface of configurations of water levels indicative of unavailable water levels of the first basket, wherein the controller is configured to implement the desired cycle of operation, the desired first and second basket configurations and the desired water level of the first and second baskets via control of the liquid supply system based on the user input.

2. The laundry treating appliance of claim 1, wherein the basket modifier interface includes three selectable configuration types including: treat laundry in the first basket only, treat laundry in the second basket only, and treat laundry in both the first basket and the second basket.

3. The laundry treating appliance of claim 2, wherein a basket modifier button is included on the user interface and operation of the basket modifier button cycles through the three selectable configuration types.

4. The laundry treating appliance of claim 3, wherein the user interface further includes an indicator indicating a currently selected one of the three selectable configuration types.

5. The laundry treating appliance of claim 2, wherein the treat laundry in the first basket only is a default selectable configuration type.

6. The laundry treating appliance of claim 1, wherein the user interface further includes an indicator indicating a currently selected water level.

7. The laundry treating appliance of claim 1, further comprising an audible alarm operably coupled to the controller and wherein the audible alarm is triggered when a user attempts to select an option on the water level interface that is unselectable.

8. The laundry treating appliance of claim 1, wherein the controller is configured to display on the user interface one of the desired cycle of operation, the desired first and second basket configurations and the desired water level of the first and second baskets via control of the liquid supply system based on the user input.

9. The laundry treating appliance of claim 1, further comprising a sensor configured to determine whether the second basket is positioned within the laundry treating appliance and provide the input to the controller indicative of the selectable options on the basket modifier interface of the selectable configurations for the first and second baskets based on a presence or absence of the second basket.

10. The laundry treating appliance of claim 1, wherein the high water level option is a maximum amount of water that can be used in a cycle of operation when the user has selected the basket modifier interface to treat laundry in the first basket only.

* * * * *